US008567615B1

(12) United States Patent
Rainey

(10) Patent No.: US 8,567,615 B1
(45) Date of Patent: Oct. 29, 2013

(54) MODULAR STACKABLE SHOE ORGANIZER KIT

(76) Inventor: Sheila O. Rainey, Orlando, FL (US)

( * ) Notice: Subject to any disclaimer, the term of this patent is extended or adjusted under 35 U.S.C. 154(b) by 154 days.

(21) Appl. No.: 13/196,541

(22) Filed: Aug. 2, 2011

(51) Int. Cl.
*A47F 7/08* (2006.01)
*A47B 61/04* (2006.01)

(52) U.S. Cl.
USPC ..... 211/36; 108/193; 312/111

(58) Field of Classification Search
USPC ..... 211/36, 134, 188, 194; 108/91, 180, 108/193, 101; 312/107, 108, 111
See application file for complete search history.

(56) References Cited

U.S. PATENT DOCUMENTS 3,234,896 A * 2/1966 Bonsall ..... 108/60
3,636,893 A * 1/1972 Lange ..... 108/190
3,655,065 A * 4/1972 Yellin ..... 211/194
3,790,241 A * 2/1974 Messina ..... 312/111
3,856,147 A * 12/1974 Piretti ..... 211/188
3,918,781 A 11/1975 Paris
3,974,917 A * 8/1976 Waxmanski ..... 211/36
4,108,514 A * 8/1978 Zimmerman ..... 312/107
4,202,586 A * 5/1980 Oplinger ..... 312/107
4,321,873 A * 3/1982 Nealis ..... 108/91
4,418,967 A * 12/1983 Winkelman et al. ..... 312/107
5,411,153 A * 5/1995 Unfried ..... 211/188
5,421,467 A * 6/1995 Dittborn ..... 211/150
5,478,145 A * 12/1995 Kamachi ..... 312/263
5,762,213 A * 6/1998 Heneveld, Sr. ..... 211/187
6,193,340 B1 2/2001 Schenker et al.
6,230,909 B1 * 5/2001 Suter ..... 211/188
6,520,095 B1 * 2/2003 Hayes ..... 108/190
6,732,858 B1 5/2004 Chang Ou
6,749,070 B2 6/2004 Corbett, Jr. et al.
7,249,674 B2 7/2007 Mu et al.
2011/0204005 A1 * 8/2011 Freitas ..... 211/4

* cited by examiner

*Primary Examiner* — Jennifer E Novosad

(57) ABSTRACT

A modular stackable shoe organizer kit that includes an interchangeable series of modular stackable shelving units with specific dimensions configurable to store shoes in a tidy and organized capacity.

6 Claims, 3 Drawing Sheets

MODULAR STACKABLE SHOE ORGANIZER KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of modular stackable shoe organizer kits are known in the prior art. However, what is needed is a modular stackable shoe organizer kit that includes an interchangeable series of modular stackable shelving units with specific dimensions configurable to store shoes in a tidy and organized capacity.

FIELD OF THE INVENTION

The present invention relates to a modular stackable shoe organizer kit, and more particularly, to a modular stackable shoe organizer kit that includes an interchangeable series of modular stackable shelving units with specific dimensions configurable to store shoes in a tidy and organized capacity.

SUMMARY OF THE INVENTION

The general purpose of the modular stackable shoe organizer kit, described subsequently in greater detail, is to provide a modular stackable shoe organizer kit which has many novel features that result in a modular stackable shoe organizer kit which is not anticipated, rendered obvious, suggested, or even implied by prior art, either alone or in combination thereof.

The storing of shoes in an accessible and tidy fashion is desirable to save space and disclose shoes for easy selection when donning specific attire. No outfit is complete without matching shoes. As a result, many shoes are procured by people and often left in disarray when not in use. Shoes require space for storage, and a way to organize shoes in a space-saving, aesthetically pleasing manner is warranted.

The present modular stackable shoe organizer kit has been devised to maximize available space in a person's closet, or elsewhere in a home, as desired. The present modular stackable shoe organizer kit has been devised to be aesthetically pleasing, easily installed, and configurable between a number of configurations to adapt to various spaces throughout a home.

The present modular stackable shoe organizer kit includes a series of modular stackable shelving units, each unit stackable atop a previous unit. Each of these modular stackable shelving units includes a parallelepiped top board and a parallelepiped bottom board disposed parallel horizontally between a pair of parallelepiped side boards.

The top board includes a top surface, a bottom surface, a first width edge and a second width edge. The bottom board is isomorphic with respect to the top board. Each of the pair of side boards has an outward surface, an inward surface, a top edge, and a bottom edge.

The top board is attachable to each of the pair of side boards by means of a pair of attachment holes disposed in both the first width edge and a second width edge. Each of the pair of side boards has a pair of first attachment holes and a pair of second attachment holes inset between the outward surface and the inward surface. The pair of first attachment holes are disposed in a plane parallel with, and proximal to, the top edge. The pair of second attachment holes are disposed in a plane parallel with the pair of first attachment holes a certain distance from the pair of first attachment holes between the top edge and the bottom edge.

A quadruplicity of fasteners releasably attach the top board and the bottom board to each of the pair of side boards, the fasteners insertable into the first and second width holes through the first and second attachment holes. Thusly, a modular stackable shelving unit is formed and stabilized.

Each of the pair of side boards also includes a dowel. This dowel is removably insertable into a first mounting hole centrally disposed in each of the pair of side boards top edge. The dowel has a top section and a bottom section. The bottom section removably inserts into the first mounting hole, and the top section removably engages with a second mounting hole centrally disposed in the bottom edge of a subsequent modular stackable shelving unit. Thusly, each modular stackable shelving unit may be removably stacked and secured in place by means of each dowel. Each of the pair of side boards has a dowel.

Each of the modular stackable shelving units of the present device has specific dimensions as presented below in this specification, configured to store a variety of shoes and footwear. In each of the modular stackable shelving units the top and bottom boards are spaced a certain distance apart, each of the shelving units having a different and specific space created between said top and bottom boards. Also, each of the pair of side boards has a specific length in each of the modular stackable shelving units.

It should be readily apparent that each of the modular stackable shelving units may be assembled and placed atop each other, or sections of the kit stacked with other units placed adjacent, or even apart, as may be desired when adapting the kit to a specific space with specific aesthetic concerns or spatial restrictions.

When stacked together, each of the modular stackable shelving units creates seven shelves and an under station. Shoes may thusly be placed on the top surface of both the top board and bottom board of each unit, and on the ground beneath the bottom board of any unit placed on the ground. Thusly, the present modular stackable shoe organizer kit enables a tidy arrangement and storage of shoes in configurations adaptable to the specific space at hand.

The instant modular stackable shoe organizer kit is envisioned to be available in a plurality of colors. The instant modular stackable shoe organizer kit is envisioned to be available made of wood, but is not restricted to wood. The modular stackable shoe organizer kit may be purchased as a kit, and freely assembled in the home, thus making transport easier.

Thus has been broadly outlined the more important features of the present modular stackable shoe organizer kit so that the detailed description thereof that follows may be better understood and in order that the present contribution to the art may be better appreciated.

Objects of the present modular stackable shoe organizer kit, along with various novel features that characterize the invention are particularly pointed out in the claims forming a part of this disclosure. For better understanding of the modular stackable shoe organizer kit, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
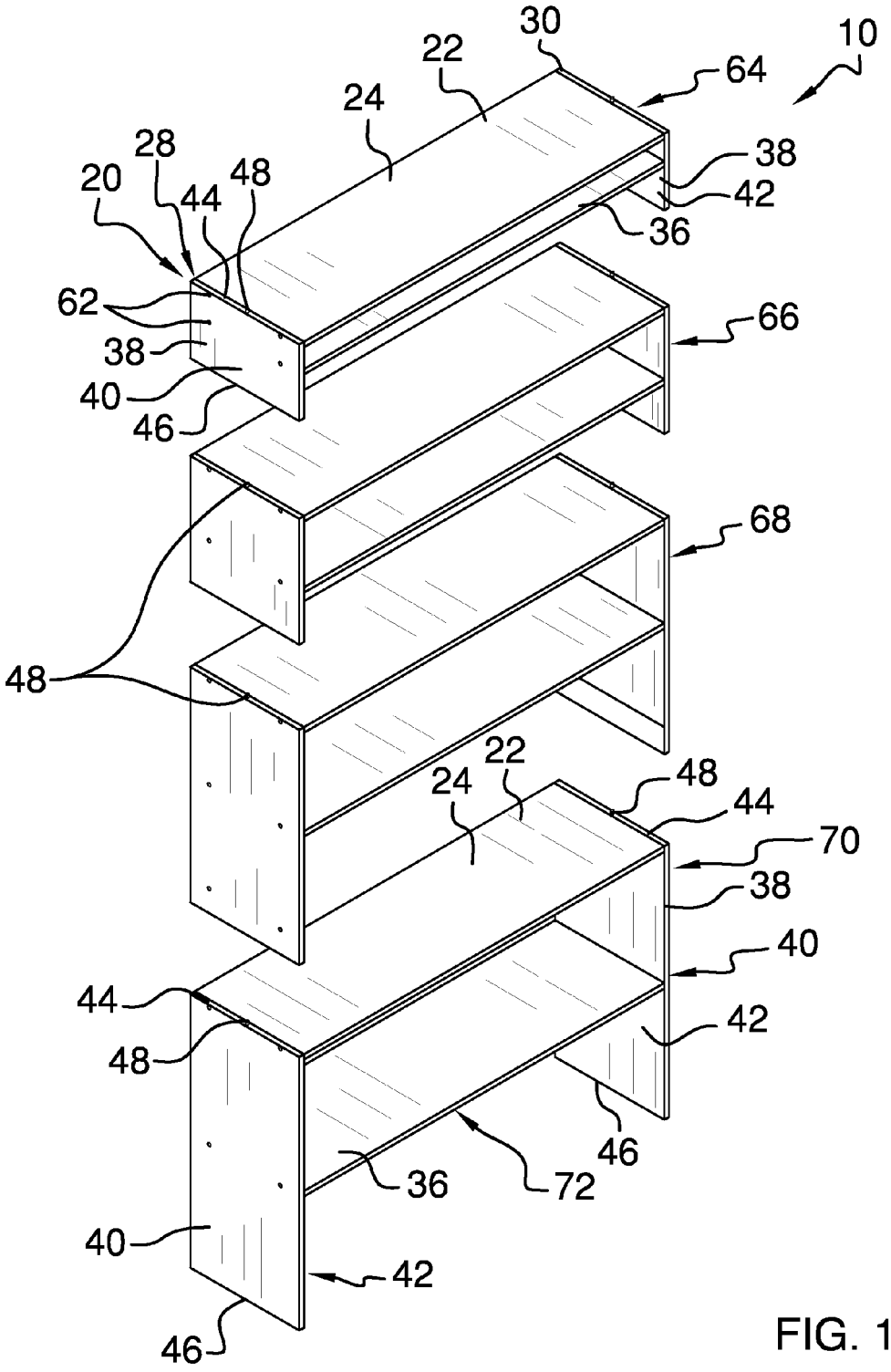
FIG. 1 is an isometric view.
Figure 2:
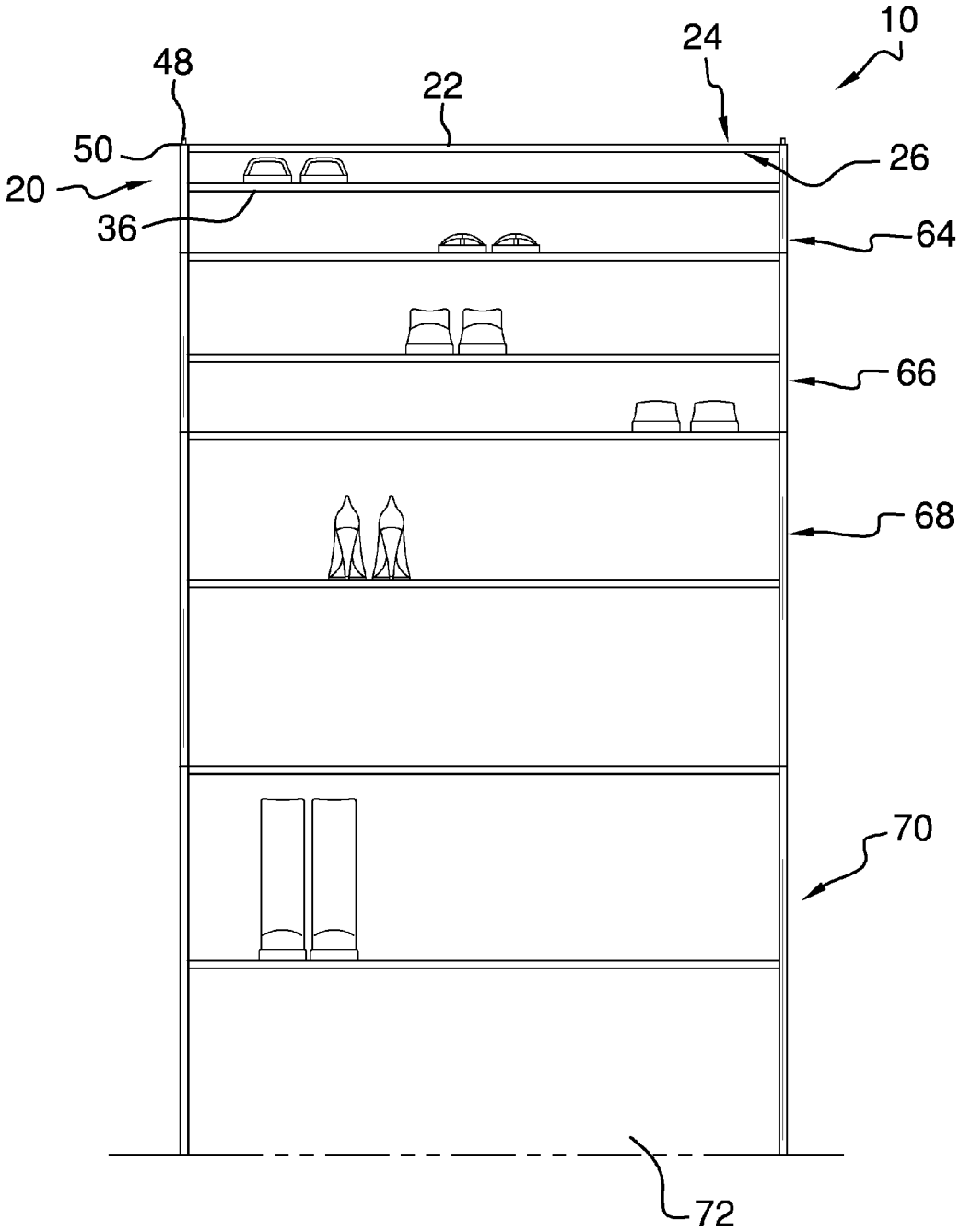
FIG. 2 is a front in-use view.
Figure 3:
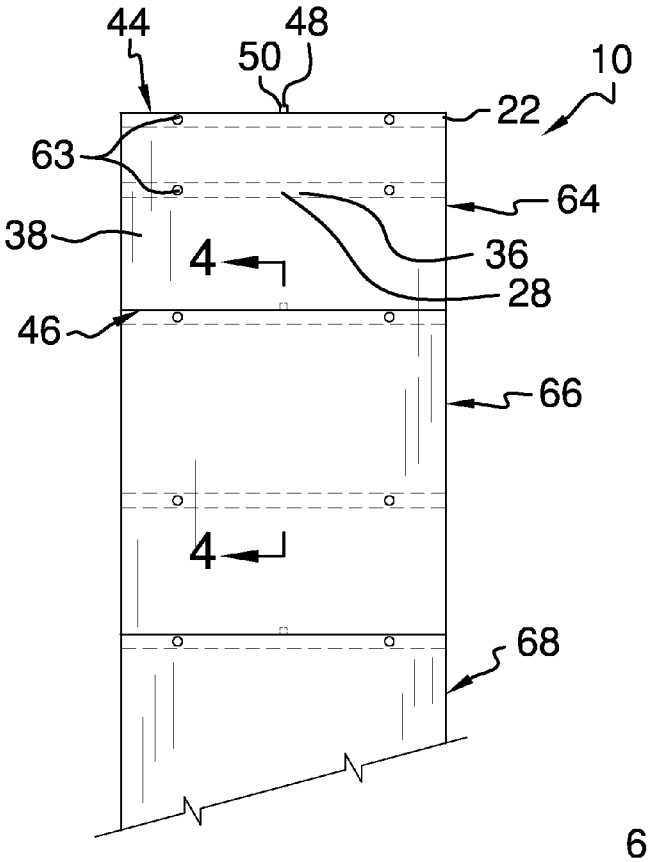
FIG. 3 is a side view.
Figure 4:
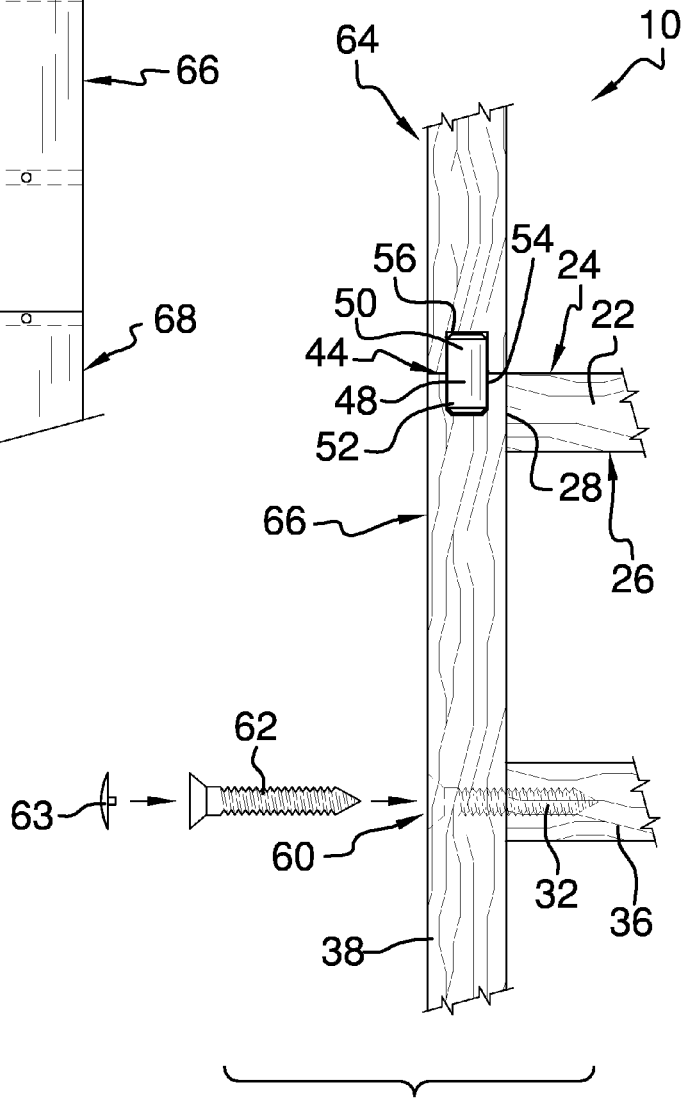
FIG. 4 is a cross section view taken along the line 4-4 of FIG. 3.

With reference now to the drawings, and in particular FIGS. 1 through 4 thereof, example of the instant modular stackable shoe organizer kit employing the principles and concepts of the present modular stackable shoe organizer kit and generally designated by the reference number 10 will be described.

Referring to FIGS. 1 through 4 a preferred embodiment of the present modular stackable shoe organizer kit 10 is illustrated.

The modular stackable shoe organizer kit 10 includes a plurality of modular stackable shelving units 20, each unit 20 including a horizontal parallelepiped top board 22, a parallelepiped bottom board 36, and a pair of parallelepiped side boards 38. The top board 22 includes a top surface 24, an undersurface 26, a first width edge 28, and a second width edge 30. A pair of first width holes 32 is disposed in the first width edge 28 and a pair of second width holes 34 is disposed in the second width edge 30.

The bottom board 36 is isomorphic with respect to the top board 22, the bottom board 36 disposed spaced-apart from, and parallel to, the top board 22. A parallelepiped pair of isomorphic side boards 38 are disposed vertically, each of the pair of side boards 38 disposed on opposing ends of both the top board 22 and the bottom board 36. Each of the pair of side boards 38 includes an outward surface 40, an inward surface 42, a top edge 44, and a bottom edge 46. Each of the pair of side boards 38 also includes a dowel 48, the dowel 48 having a top section 50 and a bottom section 52.

Each of the pair of side boards 38 further includes a first mounting hole 54 centrally disposed in the top edge 44. The first mounting hole 54 is configured to removably receive the dowel 48 bottom section 52. A second mounting hole 56 is centrally disposed in the bottom edge 46, the second mounting hole 56 configured to releasably receive the dowel 48 top section 50.

A pair of first attachment holes 58 is inset between the outward surface 40 and the inward surface 42, the pair of first attachment holes 58 disposed in a plane parallel with, and proximal to, the top edge 44. A pair of second attachment holes 60 is likewise disposed in a plane parallel to the pair of first attachment holes 58, the pair of second attachment holes 60 a known distance apart from the pair of first attachment holes 58.

A quadruplicity of fasteners 62 releasably attach each of the pair of side boards 38 to the top board 22 and the bottom board 36. The fasteners 62 are removably insertable into each of the pair of side boards 38 first 58 and second 60 attachment holes to engage with the bottom board 36 and top board 22 first 32 and second 34 width holes. When the fasteners 62 are installed, the top board 22 top surface 24 is aligned in a plane flush with each of the pair of side boards 38 top edges 44 and the bottom board 36 is disposed a certain distance from the top board 22 between each of the pair of side boards 38 top 44 and bottom 46 edges.

Each of the quadruplicity of fasteners 62 has a fastener cap 63 to cover the fastener 62 once installed.

Each of the plurality of modular stackable shelving units 20 is removably secured in place atop a previously installed unit by means of the dowel 48. When stacked together, each unit 20 may be used for the storing of shoes on the top surface 24 of both the top 22 and bottom 36 boards as desired.

A first modular unit 64 has specific dimensions wherein the top board 22 and the bottom board 36 are spaced 2 inches apart. A second unit 66 has specific dimensions, wherein the top board 22 and the bottom board 36 are placed 6 inches apart. A third unit 68 has specific dimensions wherein the top board 22 and the bottom board 36 are placed 9 inches apart. And a fourth unit 70 wherein the top board 22 and the bottom board 36 are placed 14 inches apart.

When stacked together, the first 64, second 66, third 68 and fourth 70 units create seven shelves and an under station 72 for storing shoes in a space-saving manner. However, the device 10 as envisioned may be organized with each of the modular stackable shelving units 20 configured individually, adjacent to each other, or atop each other, as desired. The modular stackable shoe organizer kit 10 is thusly configurable to specific homes and closets and is devised to allow a user the freedom to arrange the units 20 among a plurality of interconnections between units 20.

What is claimed is:

1. A modular stackable shoe organizer kit comprising:

a plurality of modular stackable shelving units, each unit comprising:

a horizontal parallelepiped top board comprising:

a top surface;

an undersurface;

a first width edge;

a second width edge;

a pair of first width holes disposed in the first width edge;

a pair of second width holes disposed in the second width edge;

a bottom board isomorphic with respect to the top board, the bottom board disposed spaced-apart from, and parallel to, the horizontal top board;

a parallelepiped pair of isomorphic side boards, disposed vertically on opposing ends of the top board and the bottom board, each of the pair of side boards comprising:

an outward surface;

an inward surface;

a top edge;

a dowel having a top section and a bottom section;

a first mounting hole centrally disposed in the top edge, the first mounting hole configured to removably receive the dowel bottom section;

a bottom edge;

a second mounting hole centrally disposed in the bottom edge, the second mounting hole configured to releasably receive the dowel top section;

a pair of first attachment holes inset between the outward surface and the inward surface, the pair of first attachment holes disposed in a plane parallel with and proximal to the top edge;

a pair of second attachment holes disposed in a plane parallel to the pair of first attachment holes, the pair of second attachment holes a known distance apart from the pair of first attachment holes;

a quadruplicity of fasteners;

wherein the quadruplicity of fasteners releasably attach each of the pair of side boards to the top board and the bottom board, the fasteners removably insertable into each of the pair of side boards first and second attachment holes to engage with the bottom board and top board first and second width holes, whereby the top board top surface is aligned in a plane flush with each of the pair of side boards top edges and the bottom board is disposed a certain distance from the top board between each of the pair of side boards top and bottom edges.

2. The modular stackable shoe organizer kit of claim 1 wherein each of the plurality of modular stackable shelving units is removably secured in place atop a previously installed unit by means of the dowel.

3. The modular stackable shelving units of claim 2 further comprising:

a first unit, wherein the top board and the bottom board are spaced 2 inches apart;

a second unit, wherein the top board and the bottom board are placed 6 inches apart;

a third unit wherein the top board and the bottom board are placed 9 inches apart;

a fourth unit wherein the top board and the bottom board are placed 14 inches apart.

4. The modular stackable shoe organizer kit of claim 3 wherein the dowel is a ¼ inch dowel.

5. The modular stackable shoe organizer kit of claim 4 wherein the top board and the bottom board are 3 feet and 2 inches long and 11.5 inches wide.

6. The modular stackable shoe organizer kit of claim 5 wherein each of the pair of side boards in each of the modular stackable shelving units has a specific length.

* * * * *